US010125982B2

(12) United States Patent
Graichen

(10) Patent No.: US 10,125,982 B2
(45) Date of Patent: Nov. 13, 2018

(54) BURNER TIP AND A BURNER FOR A GAS TURBINE

(71) Applicant: Siemens Aktiengesellschaft, Munich (DE)

(72) Inventor: Andreas Graichen, Norrköping (SE)

(73) Assignee: Siemens Aktiengesellschaft, Munich (DE)

( * ) Notice: Subject to any disclaimer, the term of this patent is extended or adjusted under 35 U.S.C. 154(b) by 104 days.

(21) Appl. No.: 15/125,455

(22) PCT Filed: Feb. 16, 2015

(86) PCT No.: PCT/EP2015/053202
§ 371 (c)(1),
(2) Date: Sep. 12, 2016

(87) PCT Pub. No.: WO2015/154902
PCT Pub. Date: Oct. 15, 2015

(65) Prior Publication Data

US 2017/0211807 A1 Jul. 27, 2017

(30) Foreign Application Priority Data

Apr. 7, 2014 (EP) ..... 14163739

(51) Int. Cl.
*F23D 14/62* (2006.01)
*F23R 3/28* (2006.01)
(Continued)

(52) U.S. Cl.
CPC ..... *F23D 14/62* (2013.01); *F23D 14/02* (2013.01); *F23D 14/82* (2013.01); *F23R 3/286* (2013.01);
(Continued)

(58) Field of Classification Search
CPC ..... F23D 14/02; F23D 14/82; F23D 14/62
(Continued)

(56) References Cited

U.S. PATENT DOCUMENTS 7,610,759 B2 * 11/2009 Yoshida ..... F23C 7/004 60/737
2005/0079464 A1 4/2005 Jordan et al.
(Continued)

FOREIGN PATENT DOCUMENTS

DE 2122653 A1 * 12/1971 ..... F23D 14/20
EP 0780631 A2 6/1997
(Continued)

OTHER PUBLICATIONS

International Search Report dated Apr. 29, 2015, for PCT application No. PCT/EP2015/053202.
(Continued)

*Primary Examiner* — Avinash Savani
*Assistant Examiner* — Aaron Heyamoto
(74) *Attorney, Agent, or Firm* — Beusse Wolter Sanks & Maire

(57) ABSTRACT

A burner device for a gas turbine with a burner body, wherein the burner body has an axial end face, a first supply channel having a first opening in the axial end face, and a burner end element arranged at the axial end face. The burner end element has a first plenum chamber coupled to the first opening of the first supply channel, such that a first fluid is feedable from the first supply channel to the first plenum chamber. The burner end element further has a lattice structure with a plurality of interconnected pores, wherein the first plenum chamber is coupled to the lattice structure for feeding the first fluid into the lattice structure. The lattice structure forms a part of a burner surface which points to a burning chamber of the gas turbine such that a
(Continued)

fluid connection between the burning chamber and the lattice structure is formed.

14 Claims, 2 Drawing Sheets

(51) Int. Cl.
*F23D 14/02* (2006.01)
*F23D 14/82* (2006.01)

(52) U.S. Cl.
CPC ..... *F23C 2900/9901* (2013.01); *F23R 2900/03343* (2013.01)

(58) Field of Classification Search
USPC ..... 431/354
See application file for complete search history.

(56) References Cited

U.S. PATENT DOCUMENTS

2011/0056205 A1* 3/2011 Carroni ..... F23C 7/002 60/737
2013/0029277 A1* 1/2013 Koizumi ..... F23R 3/10 431/354

FOREIGN PATENT DOCUMENTS

EP 1286112 A1 2/2003
EP 1647772 A1 4/2006
JP H08233271 A 9/1996

OTHER PUBLICATIONS

EP Search Report dated Sep. 19, 2014, for EP application No. 14163739.7.

* cited by examiner

BURNER TIP AND A BURNER FOR A GAS TURBINE

CROSS REFERENCE TO RELATED APPLICATIONS

This application is the US National Stage of International Application No. PCT/EP2015/053202 filed Feb. 16, 2015, and claims the benefit thereof. The International Application claims the benefit of European Application No. EP14163739 filed Apr. 7, 2014. All of the applications are incorporated by reference herein in their entirety.

FIELD OF INVENTION

The present invention relates to a burner device for a gas turbine and to a method for manufacturing the burner device.

ART BACKGROUND

In burner devices for gas turbines high temperatures are present caused by the combustion of fuel. In order to reduce emissions, in particular NOx emissions, the burned fuel mixture becomes in modern gas turbines leaner and leaner. However, leaner fuel mixture causes higher flame temperatures than richer fuel mixtures.

Furthermore, it is an aim to burn hydrogen-rich fuel in order to increase the efficiency of the gas turbine, for example. However, when burning hydrogen-rich fuel, there is a high risk of the flame burning backwards into the burner system. Moreover, flame temperatures of hydrogen rich gases are considerably higher than the traditional fuels, such as fuel on a crude oil basis.

Hydrogen rich fuel has to be mixed with other combustion gases containing oxygen, such as air or pure oxygen, in order to achieve an efficient combustion. However, mixing the hydrogen rich fuel and the oxygen-containing combustion gases is difficult to control.

SUMMARY OF THE INVENTION

It may be an object to provide a burner for a gas turbine which is adapted for being operated with hydrogen rich fuel.

This object is solved by a burner device for a gas turbine and by a method of manufacturing a burner device for a gas turbine according to the independent claims.

According to a first aspect of the present invention, a burner device for a gas turbine is presented. The burner device comprises a burner body, wherein the burner body comprises an axial end face. The burner body further comprises a first supply channel which has at least one first opening in the axial end face.

The burner device further comprises a burner end element which is arranged at the axial end face. The burner end element comprises a first plenum chamber which is coupled to the first opening of the first supply channel, such that a first fluid is feedable from the first supply channel to the first plenum chamber. The burner end element further comprises a lattice structure with a plurality of interconnected pores, wherein the first plenum chamber is coupled to the lattice structure for feeding the first fluid into the lattice structure. The lattice structure forms a part of a burner surface which points to a burning chamber of the gas turbine such that a fluid connection between the burning chamber and the lattice structure is formed. With burner surface particularly a wall of the burner is meant that has a burner surface delimiting the wall. I.e. the lattice structure is a three dimensional structure.

The burner body may comprise a tubular shape with a ring shaped cross-section, for example, but is not limited thereto. For example, the tubular shape may also have an elliptical or rectangular cross-section. Hence, the burner body with its tubular shape forms an inner passage through which air or an air/fuel mixture may stream along the axial direction.

The burner body has a symmetry axis running through the inner passage, wherein the described axial direction is parallel to the symmetry axis of the burner body. A radial direction runs through the axial direction and is perpendicular to the axial direction. Furthermore, a circumferential direction is perpendicular to the axial direction and the radial direction and runs around the axial direction and the symmetry axis, respectively.

The burner device is attachable to an upstream axial end of a combustor. The burner device injects the fuel and the air, in particular the hydrogen rich fuel and an oxygen rich gas or a mixture of both, respectively, into the burning chamber of the combustor of the gas turbine.

The burner body may comprise at least a first supply channel which has an opening at the above-mentioned axial end face of the burner body. Through the first supply channel, first fluid, such as the hydrogen rich fuel and the oxygen rich gas or a mixture of both, respectively, may be guided.

The burner end element may comprise a ring shape and is formed such that the burner end element fits onto the end face of the ring shape of the burner body.

The burner end element may be a structurally different element with respect to the burner body. Alternatively, the burner end element may be formed and manufactured directly onto the axial end face of the burner body, e.g. by additive manufacturing techniques. Hence, by applying additive manufacturing techniques, the burner end element comprising the desired design and lattice structure, respectively, is grown onto the axial end face of the burner body.

The first plenum chamber of the burner end element is arranged within the burner end element such that the first fluid is feedable from the first supply channel to the first plenum chamber if the burner end element is fixed onto the end face of the burner body. The burner end element further comprises a burner surface which is the surface which points in the direction to the inner volume of the burning chamber of the combustor of the gas turbine. The burner surface is in other words the surface of the burner device and the burner end element, respectively, which is arranged closest to a flame burning inside the burning chamber. Specifically, the burner surface is the surface through which a fuel and/or the fuel mixture is injectable into the burning chamber.

The burner surface may be a tip end surface, a radially inner surface or an outer surface of the above described tubular burner body. An exemplary embodiment described below, the burner surface may comprise a normal which is not perpendicular with the axial direction. In other words, the normal of the burner surface may be nonparallel with the radial direction. Hence, the burner end element may have a conical shape due to a tapering run or shape of the burner surface.

The burner end element according to the present invention comprises specifically a lattice structure with a plurality of interconnected pores. The lattice structure according to the present invention comprises a plurality of interconnected pores which means that the pores are in fluid connection such that a fluid may stream from a first end of the lattice structure, for example from the first plenum chamber, to another desired end of the lattice structure, such as the burner surface of the burner end element.

In particular, according to a further exemplary embodiment the pores forms small fluid channels which may have a flow diameter of smaller than approximately 0.5 mm, in particular smaller than approximately 0.3 mm.

The burner end element is made of a solid portion comprising a solid material, such as metal, and a lattice portion which comprises the lattice structure. The lattice portion is arranged and formed within the solid portion such that the lattice portion forms a kind of channel which is guided through the solid portion in a wire-like or leg-like manner. Specifically the solid portion and the lattice portion are monolithically and hence integrally formed such that the solid portion and the lattice portion form one common burner end element. Hence, the burner end element is not completely made of a lattice structure. Specifically more than 50 volume % (percentage), in particular more than 60 volume % or 70 volume % of the burner end element are made of the solid portion, wherein the other remaining volume % of the burner end element is made of the lattice portion. The lattice portion is formed within the solid portion in a predetermined line such that a desired flow channel for the respective first fluid and/or second fluid is formed. Additionally, as described in more detail below, a further lattice portion comprising the further lattice structure may be formed within the solid portion of the burner end element, wherein the lattice portion and the further lattice portion together may form less than 50 volume % of the volume of the burner end element and the other remaining volume % of the burner end element are formed by the solid portion.

Furthermore, according to a further exemplary embodiment of the present invention, the lattice structure forms frame elements between the pores, wherein each of the frame elements may have a width of more than approximately 0.5 mm.

The permeability and porousness (or porosity) of the lattice structure for guiding the first (and/or a second) fluid through the lattice structure is controllable by forming the lattice structure with a predefined ratio between a void space (i.e. the space/volume of the pores) and the bulk volume (i.e. the volume which is occupied by the frame elements).

For example, according to an exemplary embodiment of the present invention, the lattice structure comprises a ratio between a void space for the first fluid and a bulk volume of more than approximately 2/3.

The burner end element and in particular the lattice structure may be made of a metal foam. The metal foam is a cellular structure consisting of a solid metal, such as high temperature resistant material/metal, as well as a large volume fraction of gas-filled interconnected pores. The pores form an interconnected network (open-cell foam).

Furthermore, the lattice structure may be formed of a cast material, such as cast iron, wherein the lattice structure is formed by using casting techniques.

Furthermore, according to a further exemplary embodiment, the lattice structure is formed by using an additive manufacturing method, i.e. a 3D (three-dimensional) printing technique, and/or Selective Laser Melting (SLM). For a selective laser melting, the material of the burner end element may be titanium alloys, cobalt chrome alloys, stainless Steel and/or aluminum. 3D printing or additive manufacturing is a process of making a three-dimensional solid object of virtually any shape from a digital model. 3D printing is achieved using an additive process, where successive layers of material are laid down in different shapes. A 3D printer is a limited type of industrial robot that is capable of carrying out an additive process under computer control. The 3D printer is controllable under software/computer control, wherein the detailed shape and design of the pores of the lattice structure may be predefined.

The lattice structure guides the first fluid and/or the second fluid as described below from the respective plenum chamber to the burner surface for injecting the respective fluid into the burning chamber. By the approach of the present invention, the lattice structure comprises a plurality of pores such that a plurality of small fluid conductors is formed instead of one large conventional fluid conductor. Hence, by the lattice structure comprising the plurality of pores the same amount of fluid may be fed through the pores as by one conventional larger fluid channels.

Because the lattice structure according to the present invention comprises the plurality of smaller fluid conductors formed by the plurality of interconnected pores, a flashback of the flame into the smaller channels/pores is prevented. A flashback of flames is only possible if a fluid conductor has a sufficient large flow/quench diameter. Such a large flow diameter is given by the conventional flow channel in conventional burners. However, by the lattice structure of the present invention a flashback of the flames into the pores is prevented due to the small diameter of each pore.

Hence, because the risk of a flashback into the lattice structure is reduced by the burner device according to the present invention, it is possible to burn hydrogen rich fuels, which have for example a higher hydrogen amount in comparison to mineral oil based fuels. Hence, a gas turbine using the burner device of the present invention may be driven by hydrogen rich fuels, such as waste hydrogen gas from the chemical industry.

In the following, further exemplary embodiments of the present invention will be described:

According to a further exemplary embodiment of the present invention, the burner body comprises a second supply channel which has a second opening in the axial end face, wherein the burner end element comprises a second plenum chamber which is coupled to the second opening of the second supply channel, such that a second fluid is feedable from the second supply channel to the second plenum chamber. The second plenum chamber is coupled to the lattice structure for feeding the second fluid into the lattice structure, such that the first fluid and the second fluid are mixed together within the lattice structure.

Hence, the first fluid flows from the first plenum chamber into the lattice structure and the second fluid flows from the second plenum chamber into the lattice structure. The first fluid and the second fluid are mixed within the lattice structure such that a mixture of the first fluid and the second fluid is injectable from the lattice structure through the burner surface into the burning chamber. For example, the first fluid may be an oxygen rich fluid, such as air or pure oxygen, and the second fluid may be for example fuel, such as a hydrogen rich fuel or even pure hydrogen.

By mixing the first fluid and the second fuel within the lattice structure, proper mixing characteristics and in particular a homogeneous mixture of the first fluid and the second fluid is achieved.

According to a further exemplary embodiment of the present invention, wherein the burner body further comprises a plurality of first supply channels each of which has a respective further first opening in the axial end face. The burner body further comprises a plurality of second supply channels each of which has a respective further second opening in the axial end face. The burner end element comprises a plurality of first plenum chambers, wherein each of the first plenum chambers is coupled to a respective one of the first openings of the respective first supply channels, such that the first fluid is feedable from the first supply channel to the respective first plenum chamber. The burner end element comprises a plurality of second plenum chambers, wherein each of the second plenum chambers is coupled to a respective one of the second openings of the respective second supply channels, such that the second fluid is feedable from the second supply channel to the respective second plenum chamber.

The plurality of first plenum chambers and the plurality of second plenum chambers are coupled to the lattice structure for feeding the first fluid and the second fluid into the lattice structure, such that the first fluid and the second fluid is mixed together within the lattice structure.

According to a further exemplary embodiment of the present invention, the plurality of first plenum chambers and the plurality of second plenum chambers are formed along a circumferential direction in an alternating manner. Accordingly, the first supply channels and the second supply channels are formed along the circumferential direction in alternating manner.

According to a further exemplary embodiment of the present invention, the burner end element further comprises a further lattice structure with a plurality of further interconnected pores. The further lattice structure is formed spaced apart from the lattice structure, wherein the first plenum chamber is coupled to the further lattice structure for feeding the first fluid into the further lattice structure. The further lattice structure forms a further part of the burner surface, which further part is spaced apart from the part of the burner surface, such that a further fluid connection between the burning chamber and the further lattice structure is formed.

For example, the first fluid may be used as a cooling fluid, such as air, wherein the first fluid is fed in the lattice structure for being mixed with the second fluid (such as fuel) and additionally in the further lattice structure for being used as a cooling fluid. The further lattice structure comprises an outlet section at the burner surface spaced apart from an outlet section of the lattice structure at the burner surface.

Specifically, the outlet section of the further lattice structure may be formed at the hottest regions of the burner surface, such that the first fluid streaming out of the further lattice structure may cool the respective hot sections of the burner surface. Specifically, the first fluid streaming out of the further lattice structure may form a film cooling along the burner surface.

According to a further exemplary embodiment, the further lattice structure may be formed at a free end (i.e. a tip end) section of the burner end element.

According to a further exemplary embodiment, the burner end element comprises a conical section which has the burner surface, wherein the conical section tapers along an axial direction to the tip end (i.e. the free end) of the burner end element.

According to a further exemplary embodiment, the lattice structure comprises a baffle plate which is arranged within the lattice structure such that the first fluid and/or the second fluid is streamable against the baffle plate for controlling a flow characteristic of the first fluid.

The baffle plates may be a curved or straight flat plate element which is incorporated into the lattice structure such that fluid, i.e. the first fluid and/or the second fluid, streams along in order to guide the respective fluid to a desired location. Specifically, the baffle plate is formed for guiding the respective fluids along the circumferential direction such that the respective fluids are mixed with fluids streaming from the adjacent plenum chambers into the lattice structure. Hence, the baffle plates help to achieve a homogeneous mixing of the fluids being injected from the respective adjacent plenum chambers into the lattice structure.

For example, the baffle plate may comprise openings and through holes, respectively, such that a desired streaming characteristics from the respective plenum chambers to the burner surface is predefineable.

In the following, according to a further aspect of the present invention, a method of manufacturing a burner device, such as the burner device above, for a gas turbine is described.

According to the method, a burner body is provided, wherein the burner body comprises an axial end face. The burner body comprises a first supply channel which has a first opening in the axial end face.

A burner end element is arranged at the axial end face and a first plenum chamber of the burner end element is coupled to the first opening of the first supply channel, such that a first fluid is feedable from the first supply channel to the first plenum chamber. The burner end element further comprises a lattice structure with a plurality of interconnected pores, wherein the first plenum chamber is coupled to the lattice structure for feeding the first fluid into the lattice structure. The lattice structure may form a part of a burner surface which points to a burning chamber of the gas turbine such that a fluid connection between the burning chamber and the lattice structure is formed.

The part of the burner surface, where the lattice structure and an outlet section of the lattice structure is provided such that the respective fluid may be exhausted, may be formed in a recess of the burner surface surrounding the outlet section of the lattice structure. In other words, a hole, such as a blind hole or a groove running along the circumferential direction, may be formed within the burner surface, wherein the bottom of the hole forms the outlet section of the lattice structure.

The lattice structure may be formed by using 3D printing technique (i.e. additive manufacturing technique, e.g. selective laser melting SLM or sintering) or by using casting technique. When very sophisticated lattice structures are to be used, then it appears that casting is not possible but 3D printing techniques are considered the preferred way to implement these lattice structures.

Summarizing, by the present invention, the lattice structure of the bottom end element may be formed of a controlled multisystem anisotropic foam, such as metal foam, wherein the lattice structure comprises interconnected pores with very small individual channel cross-section with a high number of individual channels, forming several interconnected systems of channels. Hence, one or more different fluids, such as combustion gases and fuels, may be guided and mixed within the lattice structure.

By the present invention, conventional burner bodies may be upgraded by the above described burner end element with the lattice structure. Hence, a conventional burner device may be upgraded to a hydrogen rich fuel driven burner device, for example. Specifically, old burner end elements of a conventional burner device may be retrofitted and a new burner end element comprising the above described lattice structure may be added e.g. up by additive manufacturing technique or welding. Hence, old burner devices may be retrofitted by the above described inventive burner device.

It has to be noted that embodiments of the invention have been described with reference to different subject matters. In particular, some embodiments have been described with reference to method type claims whereas other embodiments have been described with reference to apparatus type claims. However, a person skilled in the art will gather from the above and the following description that, unless other notified, in addition to any combination of features belonging to one type of subject matter also any combination between features relating to different subject matters, in particular between features of the method type claims and features of the apparatus type claims is considered as to be disclosed with this document.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
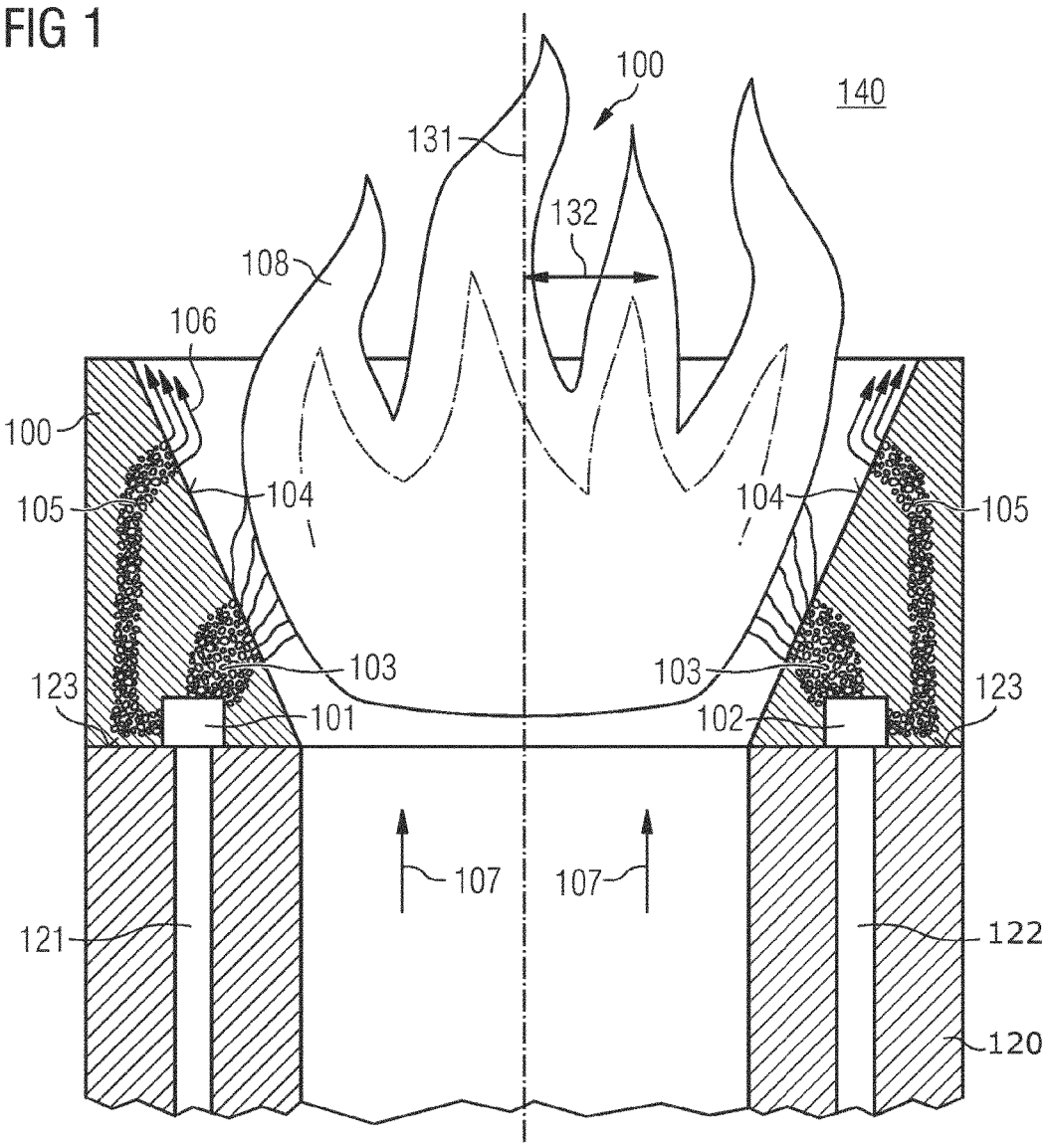
FIG. 1 shows a sectional view of a burner device for a gas turbine according to an exemplary embodiment of the present invention and FIG. 2 shows a perspective view of the burner device shown in FIG. 1.

The illustration in the drawings is in schematic form. It is noted that in different figures, similar or identical elements are provided with the same reference signs.

FIG. 1 shows a burner device for a gas turbine according to an exemplary embodiment of the present invention. The burner device comprises a burner body 120, wherein the burner body 120 comprises an axial end face 123. The burner body 120 further comprises a first supply channel 121 which has a first opening in the axial end face 123. The burner device further comprises a burner end element 100 which is arranged at the axial end face 123. The burner end element 100 comprises a first plenum chamber 101 which is coupled to the first opening of the first supply channel 121, such that a first fluid is feedable from the first supply channel 121 to the first plenum chamber 101. The burner end element 100 further comprises a lattice structure 103 with a plurality of interconnected pores, wherein the first plenum chamber 101 is coupled to the lattice structure 103 for feeding the first fluid into the lattice structure 103. The lattice structure 103 forms a part of a burner surface 104 which points to a burning chamber 140 of the gas turbine such that a fluid connection between the burning chamber 140 and the lattice structure 103 is formed.

The burner body 101 comprises a tubular shape with a ring shaped cross-section. Hence, the burner body with its tubular shape forms an inner passage through which air or an air/fuel mixture may stream along the axial direction. In the exemplary embodiment shown in FIG. 1, a main fuel mixture 107 streams along the axial direction 131.

The burner body 101 has a symmetry axis running through the inner passage, wherein the described axial direction 131 is parallel to the symmetry axis of the burner body. A radial direction 132 runs through the axial direction 131 and is perpendicular to the axial direction 131. Furthermore, a circumferential direction 233 (see FIG. 2) is perpendicular to the axial direction 131 and the radial direction 132 and runs around the axial direction 131 and the symmetry axis, respectively.

The burner device is attachable to an upstream axial end of a combustor. The burner device injects the fuel and the air, in particular the hydrogen rich fuel and an oxygen rich gas or a mixture of both, respectively, into the burning chamber 140 of the combustor of the gas turbine.

The burner body 101 comprises at least a first supply channel 121 which has an opening at the above-mentioned axial end face 123 of the burner body 120. Through the first supply channel 121, first fluid, such as oxygen rich gas such as air is guided. The burner body 101 further comprises a second supply channel 122 which has a further opening at the above-mentioned axial end face 123 of the burner body 120. Through the second supply channel 122, second fluid, such as hydrogen rich gas, is guided.

The burner end element 100 comprises a ring shape and is formed such that the burner end element 100 fits onto the end face 123 of the ring shaped the burner body 120.

The first plenum chamber 101 of the burner end element 100 is arranged within the burner end element 100 such that the first fluid is feedable from the first supply channel 121 to the first plenum chamber 101 if the burner end element 100 is fixed onto the end face 123 of the burner body 120.

The burner end element 100 further comprises a burner surface 104 which is the surface which points in the direction to the inner volume of the burning chamber 140 of the combustor of the gas turbine. The burner surface 104 is in other words the surface of the burner device and the burner end element 100, respectively, which is arranged closest to a flame 108 burning inside the burning chamber 140. Specifically, the burner surface 104 is the surface through which a fuel and/or the fuel mixture (i.e. the first and the second fluid) is injectable into the burning chamber 140.

For example, the main fuel 107 may be a lean fuel/air mixture and the first/second fluid mixture streaming out of the lattice structure may be a rich fuel/air mixture. In other words, the mixture of first/second fluid mixture may be a rich fuel mixture which forms a stable pilot flame. Hence, the mixture of first/second fluid is a so called pilot fuel mixture.

The burner surface 104 is in the exemplary embodiment in FIG. 1 a radially inner surface of the tubular burner end element 100. The burner surface 104 has a normal which is not perpendicular with the axial direction 131. In other words, the normal of the burner surface may be non-parallel with the radial direction 132. Hence, the burner end element 100 has a conical shape due to a tapering run or shape of the burner surface 104. The conical section of the burner end element 100 tapers along the axial direction 131 to the tip end (i.e. the free end) of the burner end element 100.

The burner end element 100 comprises the lattice structure 103 with a plurality of interconnected pores. The lattice structure 103 and the further lattice structure 105 as described below comprise a plurality of interconnected pores which means that the pores are in fluid connection such that the first and/or second fluid stream from a first end of the lattice structure 103, 105, for example from the first plenum chamber 101, to another desired end of the lattice structure 103, 105, such as the burner surface 104 of the burner end element 100.

The second supply channel 102 has a second opening in the axial end face 123, wherein the burner end element 100 comprises a second plenum chamber 102 which is coupled to the second opening of the second supply channel 122, such that a second fluid (such as fuel) is feedable from the second supply channel 122 to the second plenum chamber 102. The second plenum chamber 102 is coupled to the lattice structure 103 for feeding the second fluid into the lattice structure 103, such that the first fluid and the second fluid are mixed together within the lattice structure 103.

Hence, the first fluid flows from the first plenum chamber 101 into the lattice structure 103 and the second fluid flows from the second plenum chamber 102 into the same lattice structure 103. The first fluid and the second fluid are mixed within the lattice structure 103 such that a mixture of the first fluid and the second fluid is injectable from the lattice structure 103 through the burner surface 104 into the burning chamber.

By mixing the first fluid and the second fuel within the lattice structure 103, proper mixing characteristics and in particular a homogeneous mixture of the first fluid and the second fluid is achieved.

The burner end element 100 further comprises the further lattice structure 105 with a plurality of further interconnected pores. The further lattice structure 105 is formed spaced apart from the lattice structure 103, wherein the first plenum chamber 101 is coupled to the further lattice structure 105 for feeding the first fluid into the further lattice structure 105. The further lattice structure 105 forms a further part of the burner surface 104, which further part is spaced apart from the part of the burner surface 104 where the lattice structure 103 ejects the first/second fuel mixture within the burning chamber 140, such that a further fluid connection between the burning chamber 140 and the further lattice structure 105 is formed.

For example, the first fluid may be used as a cooling fluid, such as air, wherein the first fluid is fed in the lattice structure 103 for being mixed with the second fluid (such as fuel) and additionally in the further lattice structure 105 for being used as a cooling fluid. The further lattice structure comprises an outlet section at the burner surface 104 spaced apart from an outlet section of the lattice structure 103 at the burner surface 104.

Specifically, the outlet section of the further lattice structure 105 may be formed at the hottest regions of the burner surface 104, such that the first fluid streaming out of the further lattice structure 105 may cool the respective hot sections of the burner surface 104. Specifically, the first fluid streaming out of the further lattice structure 105 may form a film cooling 106 along the burner surface 104.

Figure 2:
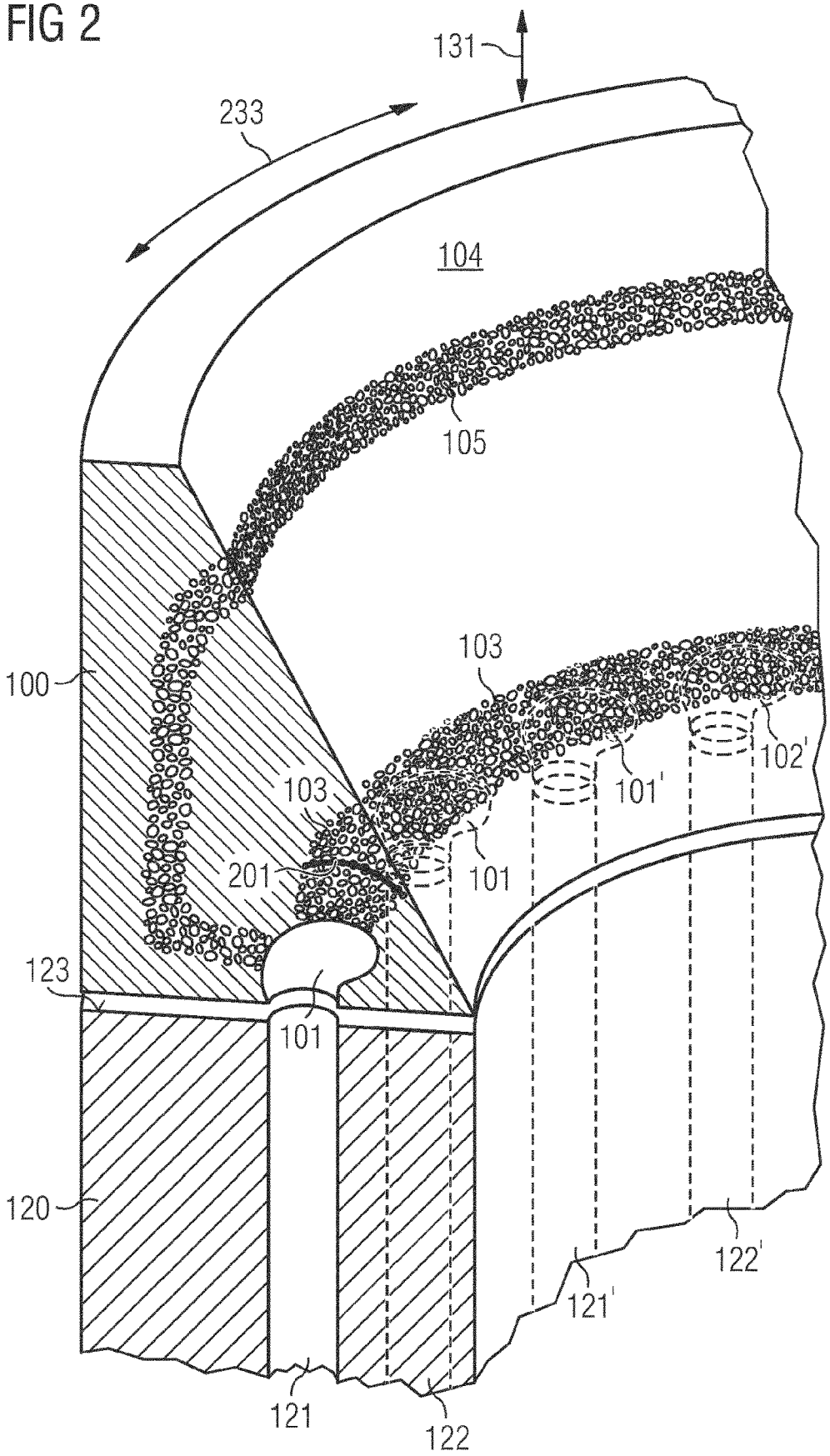

FIG. 2 shows a perspective view of the burner device shown in FIG. 1.

In FIG. 2 it is shown, that the burner body 120 further comprises a plurality of first supply channels 121, 121', wherein each of which has a respective further first opening in the axial end face 123. The burner body 120 further comprises a plurality of second supply channels 122, 122' each of which has a respective further second opening in the axial end face 123.

The burner end element 100 comprises a plurality of first plenum chambers 101, 101', wherein each of the first plenum chambers 101, 101' is coupled to a respective one of the first openings of the respective first supply channels 121, 121', such that the first fluid is feedable from the first supply channel 121, 121' to the respective first plenum chamber 101, 101'.

The burner end element 100 comprises a plurality of second plenum chambers 102, 102', wherein each of the second plenum chambers 102, 102' is coupled to a respective one of the second openings of the respective second supply channels 122, 122', such that the second fluid is feedable from the second supply channels 122, 122' to the respective second plenum chamber 102, 102'.

The plurality of first plenum chambers 101, 101' and the plurality of second plenum chambers 102, 102' are coupled to the lattice structure 103 for feeding the first fluid and the second fluid into the lattice structure 103, such that the first fluid and the second fluid is mixed together within the lattice structure 103.

The plurality of first plenum chambers 101, 101' and the plurality of second plenum chambers 102, 102' are formed along the circumferential direction 233 in an alternating manner. Accordingly, the first supply channels 121, 121' and the second supply channels 122, 122' are formed along the circumferential direction 233 in alternating manner.

The lattice structure 103 further comprises a baffle plate 201 which is arranged within the lattice structure 103 (and/or the further lattice structure 105) such that the first fluid and/or the second fluid is streamable against the baffle plate 201 for controlling a flow characteristic of the first fluid.

The baffle plate 201 may be a curved or straight flat plate element which is incorporated into the lattice structures 103, 105 such that fluid, i.e. the first fluid and/or the second fluid, streams along in order to guide the respective fluid to a desired location. Specifically, the baffle plate 201 is formed for guiding the respective fluids along the circumferential direction such that the respective fluids are mixed with fluids streaming from the adjacent plenum chambers 101, 101', 102, 102' into the lattice structure 103. Hence, the baffle plates 201 help to achieve a homogeneous mixing of the fluids being injected from the respective adjacent plenum chambers 101, 101', 102, 102' into the lattice structure 103.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A burner device for a gas turbine, the burner device comprising:

a burner body, wherein the burner body comprises an axial end face, wherein the burner body comprises a first supply channel which comprises a first opening in the axial end face, a burner end element which is arranged at the axial end face, wherein the burner end element comprises a first plenum chamber which is coupled to the first opening of the first supply channel, such that a first fluid is feedable from the first supply channel to the first plenum chamber, wherein the burner end element further comprises a lattice structure comprising a plurality of interconnected pores, wherein the lattice structure comprises an foam;

wherein the first plenum chamber is coupled to the lattice structure for feeding the first fluid into the lattice structure, wherein the lattice structure forms a part of a burner surface which points to a burning chamber of the gas turbine such that a fluid connection between the burning chamber and the lattice structure is formed, wherein the burner body comprises a second supply channel which comprises a second opening in the axial end face, wherein the burner end element comprises a second plenum chamber which is coupled to the second opening of the second supply channel, such that a second fluid is feedable from the second supply channel to the second plenum chamber, wherein the second plenum chamber is coupled to the lattice structure for feeding the second fluid into the lattice structure, such that the first fluid and the second fluid is mixed together within the lattice structure.

2. The burner device according to claim 1, wherein the burner body further comprises a plurality of first supply channels each of which comprises a respective further first opening in the axial end face, wherein the burner body further comprises a plurality of second supply channels each of which comprises a respective further second opening in the axial end face, wherein the burner end element comprises a plurality of first plenum chambers, wherein each of which is coupled to a respective one of the first openings of the respective first supply channels, such that the first fluid is feedable from the first supply channel to the respective first plenum chamber, wherein the burner end element comprises a plurality of second plenum chambers, wherein each of which is coupled to a respective one of the further second openings of the respective second supply channels, such that the second fluid is feedable from the second supply channel to the respective second plenum chamber, and wherein the plurality of first plenum chambers and the plurality of second plenum chambers are coupled to the lattice structure for feeding the first fluid and the second fluid into the lattice structure, such that the first fluid and the second fluid is mixed together within the lattice structure.

3. The burner device according to claim 2, wherein the plurality of first plenum chambers and the plurality of second plenum chambers are formed along a circumferential direction in an alternating manner.

4. The burner device according to claim 1, wherein the burner end element further comprises a further lattice structure discrete from the lattice structure and comprising a plurality of further interconnected pores, wherein the further lattice structure is formed spaced apart from the lattice structure, wherein the first plenum chamber is coupled to the further lattice structure for feeding the first fluid into the further lattice structure, and wherein the further lattice structure forms a further part of the burner surface, which further part is spaced apart from the part of the burner surface, such that a further fluid connection between the burning chamber and the further lattice structure is formed.

5. The burner device according to claim 1, wherein the burner end element comprises a conical section which comprises the burner surface, wherein the conical section tapers along an axial direction to a tip end of the burner end element.

6. The burner device according to claim 1, wherein the lattice structure comprises a ratio between a void space for the first fluid and a bulk volume of more than 4/6.

7. The burner device according to claim 1, wherein pores in the first supply channel form fluid channels comprising a flow diameter smaller than 0.3 mm.

8. The burner device according to claim 1, wherein the lattice structure forms frame elements between pores, wherein each of the frame elements comprises a width of more than 0.5 mm.

9. The burner device according to claim 1, wherein the lattice structure comprises a baffle plate which is arranged within the lattice structure such that the first fluid is streamable against the baffle plate for controlling a flow characteristic of the first fluid.

10. A method of manufacturing a burner device for a gas turbine, the method comprising:

providing a burner body, wherein the burner body comprises an axial end face, wherein the burner body comprises a first supply channel which comprises a first opening in the axial end face, wherein the burner body comprises a second supply channel that is discrete from the first supply channel and which comprises a second opening in the axial end face, arranging a burner end element at the axial end face, coupling a first plenum chamber of the burner end element to the first opening of the first supply channel, such that a first fluid is feedable from the first supply channel to the first plenum chamber, coupling a second plenum chamber of the burner end element to the second opening of the second supply channel, such that a second fluid is feedable from the second supply channel to the second plenum chamber, wherein the burner end element further comprises a lattice structure comprising a plurality of interconnected pores, wherein the lattice structure comprises an foam, wherein the first plenum chamber and the second plenum chamber are coupled to the lattice structure for feeding the first fluid into the lattice structure, and wherein the lattice structure forms a part of a burner surface which points to a burning chamber of the gas turbine such that a fluid connection between the burning chamber and the lattice structure is formed.

11. The method according to claim 10, wherein the lattice structure is formed by using 3D printing technique or by using casting technique.

12. A burner device, comprising:

a burner body; a burner surface at a downstream end of the burner body and which faces a combustion chamber; and a central passage through the burner body and in fluid communication with the combustion chamber;

a first anisotropic foam structure disposed in the burner body and in fluid communication with a first outlet in the burner surface; and a first supply channel in the burner body and in fluid communication with the first anisotropic foam structure; and a second supply channel in the burner body which is fluidically discrete from the first supply channel and also in fluid communication with the first anisotropic foam structure;

wherein the first anisotropic foam structure is configured to receive an oxygen containing fluid from the first supply channel, to mix it with a fuel received from the second supply channel to form a mixture, and to deliver the mixture through the first outlet to the combustion chamber.

13. The burner device according to claim 12, further comprising a second anisotropic foam structure discrete from the first anisotropic foam structure, disposed in the burner body, in fluid communication with a second outlet in the burner surface disposed downstream of the first outlet, and in fluid communication with the first supply channel but not the second supply channel.

14. The burner device according to claim 13, wherein the second outlet is configured to deliver the oxygen containing fluid to form a film cooling of the burner surface.

* * * * *